US010688020B2

(12) United States Patent
Py

(10) Patent No.: US 10,688,020 B2
(45) **Date of Patent: *Jun. 23, 2020**

(54) SEPTUM THAT DECONTAMINATES BY INTERACTION WITH PENETRATING ELEMENT

(71) Applicant: Dr. Py Institute LLC, New Milford, CT (US)

(72) Inventor: Daniel Py, Larchmont, NY (US)

(73) Assignee: DR. PY INSTITUTE LLC, New Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/944,094

(22) Filed: Apr. 3, 2018

(65) Prior Publication Data

US 2018/0353378 A1 Dec. 13, 2018

Related U.S. Application Data

(63) Continuation of application No. 15/267,131, filed on Sep. 15, 2016, now Pat. No. 9,931,274.

(60) Provisional application No. 62/219,035, filed on Sep. 15, 2015.

(51) Int. Cl.
*A61J 1/14* (2006.01)

(52) U.S. Cl.
CPC ..... *A61J 1/1406* (2013.01)

(58) Field of Classification Search
CPC ..... A61J 1/1406
USPC ..... 141/329
See application file for complete search history.

(56) References Cited

U.S. PATENT DOCUMENTS

| | | | | |
|---|---|---|---|---|
| 2,364,126 A | | 12/1944 | Cantor et al. | |
| 2,395,149 A | | 2/1946 | Shaw | |
| 3,637,102 A | | 12/1972 | Shaw | |
| 4,545,497 A | | 10/1985 | Martha, Jr. | |
| 4,671,331 A | | 6/1987 | Pruden | |
| 4,834,152 A | * | 5/1989 | Howson | A61J 1/2089 141/27 |

(Continued)

FOREIGN PATENT DOCUMENTS

| | | |
|---|---|---|
| WO | 9609539 A1 | 3/1996 |
| WO | 2011006131 A1 | 1/2011 |

(Continued)

*Primary Examiner* — Timothy L Maust
(74) *Attorney, Agent, or Firm* — McCarter & English, LLP

(57) ABSTRACT

A septum is penetrable by a needle for decontamination by physical interaction. The septum can include a peripheral portion, an exterior surface, and an interior surface. A penetration portion extends between the exterior and interior surfaces, is spaced inwardly of the peripheral portion, and is penetrable by the needle or other penetrating element. A flex portion is located between the penetration portion and the peripheral portion. A thicker portion extends between the flex portion and the penetration portion, and defines an increased thickness between the exterior and interior surfaces relative to the flex portion. The flex portion is flexible inwardly relative to the peripheral portion during penetration of the penetration portion by a needle or other penetrating element. The penetration portion physically interacts with and decontaminates the needle when it penetrates the septum. The septum may also reduce or prevent retrograde contamination when the needle is withdrawn.

33 Claims, 5 Drawing Sheets

(56) References Cited

U.S. PATENT DOCUMENTS

| | | | | |
|---|---|---|---|---|
| 4,954,149 | A * | 9/1990 | Fullemann | G01N 30/18 210/198.2 |
| 5,584,850 | A | 12/1996 | Hart et al. | |
| 5,632,396 | A | 5/1997 | Burns | |
| 5,656,035 | A | 8/1997 | Avoy | |
| 56,560,351 | | 8/1997 | Avoy | |
| 5,673,535 | A | 10/1997 | Jagger | |
| 5,679,399 | A | 10/1997 | Shlenker et al. | |
| 5,931,828 | A | 8/1999 | Durkee | |
| 5,957,898 | A | 9/1999 | Jepson et al. | |
| 6,145,688 | A | 11/2000 | Smith | |
| 6,387,078 | B1 | 5/2002 | Gillespie, III | |
| 6,478,775 | B1 | 11/2002 | Galt et al. | |
| 6,604,561 | B2 | 8/2003 | Py | |
| 6,684,916 | B2 | 2/2004 | Py | |
| 6,805,170 | B2 | 10/2004 | Py | |
| 6,902,207 | B2 | 6/2005 | Lickliter | |
| 6,929,040 | B2 | 8/2005 | Py | |
| 7,032,631 | B2 | 4/2006 | Py | |
| 7,096,896 | B2 | 8/2006 | Py | |
| 7,100,646 | B2 | 9/2006 | Py | |
| 7,111,649 | B2 | 9/2006 | Py | |
| 7,243,689 | B2 | 7/2007 | Py | |
| 7,270,158 | B2 | 9/2007 | Py | |
| 7,322,491 | B2 | 1/2008 | Py | |
| 7,445,033 | B2 | 11/2008 | Py | |
| 7,490,639 | B2 | 2/2009 | Py | |
| 7,500,498 | B2 | 3/2009 | Py | |
| 7,556,066 | B2 | 7/2009 | Py | |
| 7,628,184 | B2 | 12/2009 | Py | |
| 7,648,491 | B2 | 1/2010 | Rogers | |
| 7,669,390 | B2 | 3/2010 | Py | |
| 7,707,807 | B2 | 5/2010 | Py | |
| 7,726,352 | B2 | 6/2010 | Py | |
| 7,726,357 | B2 | 6/2010 | Py et al. | |
| 7,736,333 | B2 | 6/2010 | Gillespie, III | |
| 7,780,023 | B2 | 8/2010 | Py | |
| 7,810,529 | B2 | 10/2010 | Py | |
| 7,905,527 | B1 | 3/2011 | Py | |
| 7,954,521 | B2 | 6/2011 | Py | |
| 7,967,034 | B2 | 6/2011 | Py | |
| 7,967,037 | B2 | 6/2011 | Py | |
| 7,975,453 | B2 | 7/2011 | Py | |
| 7,980,276 | B2 | 7/2011 | Py | |
| 7,992,597 | B2 | 8/2011 | Py | |
| 8,002,130 | B2 | 8/2011 | Thilly | |
| 8,096,333 | B2 | 1/2012 | Py | |
| 8,112,972 | B2 | 2/2012 | Py | |
| 8,347,923 | B2 | 1/2013 | Py | |
| 8,376,003 | B2 | 2/2013 | Py | |
| 8,403,894 | B2 | 3/2013 | Lynn et al. | |
| 8,408,256 | B2 | 4/2013 | Py | |
| 8,631,838 | B2 | 1/2014 | Py | |
| 8,646,243 | B2 | 2/2014 | Py | |
| 8,671,964 | B2 | 3/2014 | Py | |
| 8,739,838 | B2 | 6/2014 | Py | |
| 9,347,923 | B1 | 5/2016 | Allendorf et al. | |
| 9,604,740 | B2 * | 3/2017 | Py | A61J 3/002 |
| 9,931,274 | B2 * | 4/2018 | Py | A61J 1/1406 |
| 2005/0261627 | A1 | 11/2005 | Shue et al. | |
| 2007/0180796 | A1 | 8/2007 | Wild et al. | |
| 2007/0197960 | A1 | 8/2007 | Ritsher et al. | |
| 2007/0225635 | A1 | 9/2007 | Lynn | |
| 2009/0054865 | A1 | 2/2009 | Brandenburger et al. | |
| 2009/0078337 | A1 | 3/2009 | Gustafsson et al. | |
| 2009/0098250 | A1 | 4/2009 | Py | |
| 2009/0134114 | A1 | 5/2009 | Thilly | |
| 2009/0139883 | A1 | 6/2009 | Py et al. | |
| 2009/0139953 | A1 | 6/2009 | Py | |
| 2010/0051575 | A1 | 3/2010 | Ou et al. | |
| 2010/0107784 | A1 | 5/2010 | Stein | |
| 2010/0236659 | A1 | 9/2010 | Py | |
| 2011/0277873 | A1 | 11/2011 | Py | |
| 2012/0152881 | A1 | 6/2012 | Py | |
| 2012/0261027 | A1 | 10/2012 | Py | |
| 2013/0008137 | A1 | 1/2013 | Py | |
| 2013/0190704 | A1 | 7/2013 | Py | |
| 2013/0270820 | A1 | 10/2013 | Py | |
| 2013/0292592 | A1 | 11/2013 | Py | |
| 2013/0333796 | A1 | 12/2013 | Py | |
| 2014/0311617 | A1 | 10/2014 | Py | |
| 2015/0122369 | A1 | 5/2015 | Py | |
| 2016/0038373 | A1 | 2/2016 | Ohlin | |

FOREIGN PATENT DOCUMENTS

| | | |
|---|---|---|
| WO | 2011137413 | 11/2011 |
| WO | 2012013585 A1 | 2/2012 |
| WO | 2012177933 | 12/2012 |
| WO | 2014114807 A1 | 7/2014 |

* cited by examiner

SEPTUM THAT DECONTAMINATES BY INTERACTION WITH PENETRATING ELEMENT

CROSS-REFERENCE TO RELATED APPLICATION

This patent application is a continuation of U.S. patent application Ser. No. 15/267,131, filed Sep. 15, 2016, which claims benefit under 35 U.S.C. § 119 to similarly-titled U.S. Provisional Patent Application No. 62/219,035, filed Sep. 15, 2015, which is hereby incorporated by reference in its entirety as part of the present disclosure.

FIELD OF THE INVENTION

The present invention relates (i) to devices and methods for decontaminating a surface, such as a cylindrical or frustoconical surface of a filling needle, by pure physical interaction with a wiping ring defined by a penetrable septum, (ii) to such a septum that is penetrable by a needle or other penetrating element; (iii) to devices and methods for decontaminating a filling needle, such as a closed filling needle, by interaction with a septum penetrable by the needle, where the resulting penetration hole in the septum is self-closing and re-sealable, such as hermetic resealing by thermal, chemical or mechanical resealing; and (iv) to devices and methods that enable sterile transfer of a product from within a closed needle or other closed penetration element into another closed sterile member or device, such as a sterile connector, connecting member or container.

BACKGROUND INFORMATION

A typical septum, such as stopper used to seal a vial or other device, is made of a material with some elongation property, such as an elastomer, or a rubber-like material, such as thermoplastic elastomer or silicone. The septum comprises an exterior surface defining a penetration zone that is penetrable by a needle, and an interior flange located on the underside of the septum that is received within, or otherwise attached to seal an opening in the vial or other type of device. The septum typically defines a flat exterior surface and a certain wall thickness in and around the penetration zone.

One of the drawbacks of such prior art septa is that when a needle penetrates through the penetration zone, the exterior surface that engages the needle cracks at the penetration site and can, in turn, invaginate, curl or roll inwardly at the opening about the needle, particularly under the axially-inward force exerted on the septum by the needle. As a result, any germs, bacteria or other contaminants on the exterior surface at the needle opening can be placed in communication with, and contaminate the interior of the vial or other device.

SUMMARY OF THE INVENTION

It is an object of the present invention to overcome one or more of the above-described drawbacks of the prior art.

In accordance with a first aspect, a septum is penetrable by a needle or other penetrating element and decontaminates by interaction between the septum and penetrating element. The septum comprises a peripheral portion extending about a periphery of the septum, an exterior surface located on the external side of the septum that may be exposed to a contaminated environment, and an internal surface that may be exposed to a sterile chamber or other sterile environment. A penetration area or portion of the septum extends between the exterior and interior surfaces, is spaced inwardly of the peripheral portion, and is penetrable by the needle or other penetrating element. A flex portion of the septum is located between the penetration area and the peripheral portion. A thicker portion of the septum extends between the flex portion and the penetration area, and preferably defines a thicker portion between the exterior and interior surfaces relative to the flex portion. The flex portion is flexible inwardly relative to the peripheral portion during penetration of the penetration area by a needle or other penetrating element, and the penetration portion physically interacts with and decontaminates the needle or other penetrating element.

In some embodiments, the thicker portion extends annularly about the penetration portion. In some such embodiments, the septum defines an axis of symmetry, the flex portion is located on one side of a plane that is substantially normal to the axis of symmetry, and at least a portion of the interior surface defining the thicker portion is located on an opposite side of the plane relative to the flex portion. In some such embodiments, the interior surface of the thicker portion is spaced below the plane, and the interior surface of the flex portion is spaced above the plane. In some embodiments, the thicker portion is defined by a curvilinear-shaped interior surface. In some such embodiments, the thicker portion is defined by a substantially dome-shaped interior surface. In some such embodiments, the dome-shaped interior surface defines a recess, such as a substantially concave-shaped recess, at the penetration area. In some embodiments, the thicker portion is defined by a substantially toroidal-shaped, semi-toroidal-shaped, or partial toroidal-shaped interior surface. In some embodiments, the thicker portion is substantially convex-shaped in cross section, and preferably defines an annularly extending, substantially convex lobe that depends downwardly and extends between the flex and penetration portions.

In some embodiments, the penetration area defines a reduced thickness between the exterior and interior surfaces as compared to the thicker portion. In some embodiments, the exterior surface is one or more of substantially dome-shaped and substantially convex-shaped. In some such embodiments, the penetration area is defined by a recess in the exterior surface. In some such embodiments, the recess is substantially conically shaped. In some such embodiments, the recess is substantially frustoconically shaped. In some embodiments, the recess defines a substantially planar base portion forming a penetrable exterior surface of the penetration area.

In some embodiments, the flex portion includes a groove in the exterior surface extending about the thicker portion between the thicker portion and the peripheral portion. In some such embodiments, the groove extends annularly about the thicker portion and extends radially between the peripheral portion and the thicker portion. In some such embodiments, the groove is substantially v-shaped or u-shaped in cross section.

In some embodiments, both the exterior surface and the interior surface at the thicker portion are approximately dome-shaped. In some such embodiments, the exterior surface is approximately convex-shaped, and the interior surface at the thicker portion is also approximately convex-shaped. In some such embodiments, the flex portion defines an annular recess extending between the peripheral portion and the thicker portion. In some such embodiments, the annular recess is approximately concave-shaped in cross section.

In some embodiments, the thicker portion is configured/adapted to one or more of (i) reduce strain on the interior surface of the penetration area as compared to the exterior surface of the penetration area during penetration by the needle or other penetrating element; (ii) apply an annular zone of relatively high radial pressure between an exterior surface of the penetration area and the needle or other penetrating element, as compared to the radial pressure between an interior surface of the penetration area and the needle or other penetrating element during penetration by the needle or other penetrating element; and (iii) space the exterior surface at the penetration portion from the interior surface during penetration by the needle or other penetrating element to thereby provide a zone or ring of safety between the exterior and interior surfaces where the needle or other penetrating element penetrates the penetration area.

In some embodiments, the peripheral portion is one or more of co-molded with, over-molded to, or fixedly secured to, a mounting surface of a device. The device may take the form of any of numerous different devices that are currently known or that later become known, including devices with storage chambers sealed with respect to the ambient atmosphere by one or more septa, such as vials, syringes, bottles, containers, tubes, and dispensers, and connectors, such as sterile connectors where the septum forms a part of a female connector that is penetrated by a male connector to form a sterile connection between the male and female connectors, and to transfer a product or fluid through the sterile connection.

In some embodiments, the penetration portion is configured such that an aperture formed in the septum by the needle or other penetrating element closes or seals progressively in a direction from the interior surface of the septum toward the exterior surface of the septum as the needle or other penetrating element is withdrawn from the septum. In some embodiments, the septum is configured to prevent liquid or contaminants from passing or flowing from the exterior surface of the septum to the interior surface of the septum as the needle or other penetrating element is withdrawn from the septum. The septum may also be configured to move liquid film or contaminants from one or more of (i) a surface of the needle or other penetrating element or (ii) the penetration portion and toward the exterior surface of the septum during withdrawal of the needle or other penetrating element from the septum.

In accordance with another aspect, a septum is penetrable by a needle or other penetrating element and decontaminates by interaction between the septum and penetrating element. The septum comprises: (i) first means extending about a periphery of the septum for attaching the septum to a device; (ii) second means extending between exterior and interior surfaces of the septum that is spaced inwardly of the first means for penetration by the needle or other penetrating element and for physically interacting with and decontaminating the needle or other penetrating element; (iii) third means located between the first means and the second means for flexing inwardly relative to the first means during penetration of the second means by a needle or other penetrating element; and (iv) fourth means extending between the second means and the third means for one or more of (a) reducing strain on the interior surface of the second means as compared to the exterior surface of the second means during penetration by the needle or other penetrating element, (b) applying an annular zone of relatively high pressure between an exterior portion of the second means and the needle or other penetrating element as compared to an interior portion of the second means, and (c) spacing the exterior surface at the second means from the interior surface thereof during penetration thereof by the needle or other penetrating element, to thereby provide a zone or ring of safety between the exterior and interior surfaces where the needle or other penetrating element penetrates the second means.

In some embodiments of the present invention, the first means is a peripheral portion of the septum, the second means a penetration portion or area of the septum, the third means is a flex portion of the septum, and the fourth means is an increased thickness or thicker portion of the septum.

In accordance with another aspect, a method, such as a method of decontaminating a needle or other penetrable element by physical interaction between the needle or other penetrating element during penetration of a septum, comprises the following steps:

- penetrating a penetration portion of the septum defining an exterior surface and an interior surface with a needle or other penetrating element;
- during said penetrating step, applying a zone of relatively high, approximately radial pressure onto the needle or other penetrating element at or near the exterior surface of the penetration portion, and applying a zone of relatively lower, approximately radial pressure onto the needle or other penetrating element at or nearer to the interior surface of the penetration portion; and
- progressively wiping an exterior surface of the needle or other penetrating element at at least the zone of relatively high, approximately radial pressure as the needle or other penetrating element penetrates through the septum and thereby decontaminating portions of the needle or other penetrating element.

In some embodiments, the method further comprises reducing the strain, or incurring a lower strain, on the interior surface of the penetration area as compared to the exterior surface of the penetration area, during penetration by the needle or other penetrating element. Such embodiments may further comprise preventing the exterior surface of the penetration area from invaginating, curling or rolling inwardly at or about the penetration hole about the needle as the needle or other penetrating element pierces through the interior surface of the penetration area. Such embodiments may further comprise preventing any germs, bacteria or other contaminants on the exterior surface at the penetration hole from being placed in communication with, and contaminating the interior of the septum, or the environment of the interior surface of the septum, such as a sterile chamber of a device.

Some embodiments further comprise spacing the exterior surface at the penetration area from the interior surface thereof during penetration by the needle or other penetrating element, and providing a zone or ring of safety between the exterior and interior surfaces at the interface of the needle or other penetrating element. The zone or ring of safety prevents any germs, bacteria or other contaminants on the exterior surface at the penetration hole from being placed in communication with, and contaminating the interior of the septum, or the environment of the interior surface of the septum, such as a sterile chamber of a device.

In some embodiments, the method further comprises withdrawing the needle or other penetrating element from the septum, and, during this withdrawing, applying a zone of relatively high, approximately radial pressure onto the needle or other penetrating element at or near the exterior surface of the penetration portion, and applying a zone of relatively lower, approximately radial pressure onto the needle or other penetrating element at or near the internal surface of the penetration portion. In some such embodiments, the method may further comprise progressively wiping the needle or other penetrating element and thereby preventing liquid or contaminants from passing or flowing from the exterior surface of the penetration portion or the exterior surface of the needle or other penetrating element to the interior surface of the penetration portion.

In some such embodiments, the step of wiping during the withdrawing step includes wiping the needle or other penetrating element in a direction from the interior surface of the septum toward the exterior surface of the septum. In some such embodiments, the method further comprises progressively closing or sealing an aperture formed in the septum by the needle or other penetrating element in a direction from the interior surface of the penetration portion toward the exterior surface of the penetration portion. In some such embodiments, the method may comprise moving liquid film or contaminants from one or more of (i) a surface of the needle or other penetrating element or (ii) the penetration portion and toward the exterior surface of the penetration portion during withdrawal of the needle or other penetrating element from the septum.

One advantage of embodiments of the present invention is that the thicker portion reduces the strain on the interior surface of the penetration area as compared to the exterior surface of the penetration area during penetration thereof by the needle or other penetrating element. As a result, when the needle or other penetrating element pierces through the interior surface of the penetration area, the exterior surface is generally prevented from invaginating, curling or rolling inwardly at the penetration hole about the needle. This in turn prevents or reduces any germs, bacteria or other contaminants on the exterior surface at the penetration hole from being placed in communication with, and contaminating the interior of the septum, or the environment of the interior surface of the septum.

Yet another advantage of some embodiments of the present invention is that the dome-, convex- or other curvilinear-shaped exterior surface of the septum, in cooperation with the increased thickness portion, applies an annular zone or ring of relatively high radial pressure between the exterior surface of the penetration area and the needle or other penetrating element, as compared to the radial pressure between the interior surface of the penetration area and the needle or other penetrating element during penetration by the needle or other penetrating element. The annular ring of relatively high, radially-directed pressure is applied to the tip of the needle or other penetrating element at the interface of the pierced external surface of the septum as the tip penetrates the septum. Thus, as the needle or other penetrating element continues to penetrate the septum, the annular ring of relatively high, radially-directed pressure consecutively or progressively wipes the entire surface of the penetrating element that contacts the septum as it penetrates through the septum. The annular ring of relatively high pressure actively wipes the surface(s) of the penetrating element, starting at the tip as it penetrates the septum, and then progressively moves along the surfaces of the penetrating element as they penetrate the septum, to thereby decontaminate the penetrating element through such physical interaction between the septum and penetrating element.

Yet another advantage various embodiments of the present invention is that the strain reduction of the interior sterile layer enabled by the thicker portion spaces the external contaminated surface at the penetration portion from the sterile interior surface during penetration by the needle or other penetrating element, and thereby provides a zone or ring of safety between the exterior and interior surfaces in the penetration portion. As the needle or other penetrating element penetrates the penetration area, it stretches the material of the penetration area, thereby reducing the density of germs by surface elongation. The thicker portion about the penetration area, by elastic radial deformation, maintains sufficient inward or radially-directed pressure to generally prevent the depressed external surface from invaginating into the sterile inner cavity, and increases the zone or ring of safety between the exterior and interior surfaces at the interface between the needle or other penetrating element and the septum. The deformation as a whole is engineered to provide a relatively high pressure interface between the septum and penetrating element, the dynamics of which applies a wiping wave along the surfaces of the penetrating element as it penetrates through the septum, to thereby decontaminate the surfaces through such physical interaction, such as by the stress and friction at the interface.

Other objects and advantages of the present invention, and/or of the disclosed embodiments, will become more readily apparent in view of the following detailed description of embodiment and accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
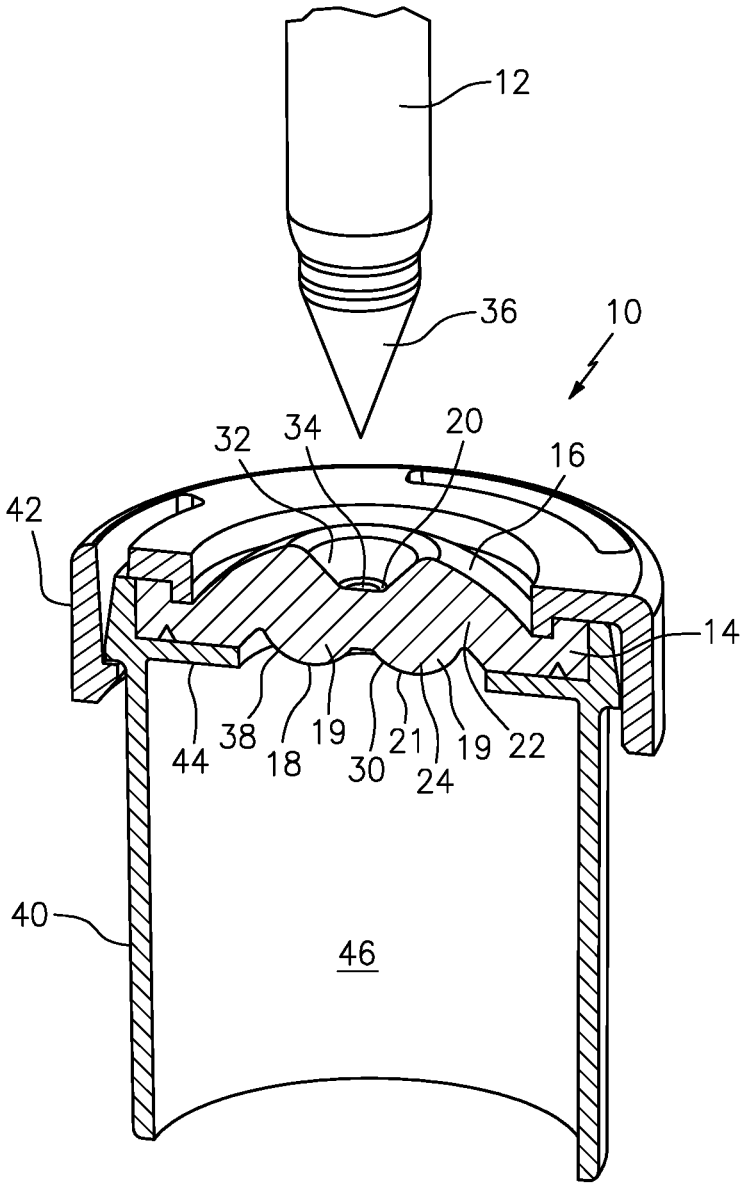
FIG. 1 is a perspective, cross-sectional view of a septum mounted to a vial to seal a chamber of the vial, and illustrating a filling needle above the penetration area of the septum prior to penetrating the septum.
Figure 2:
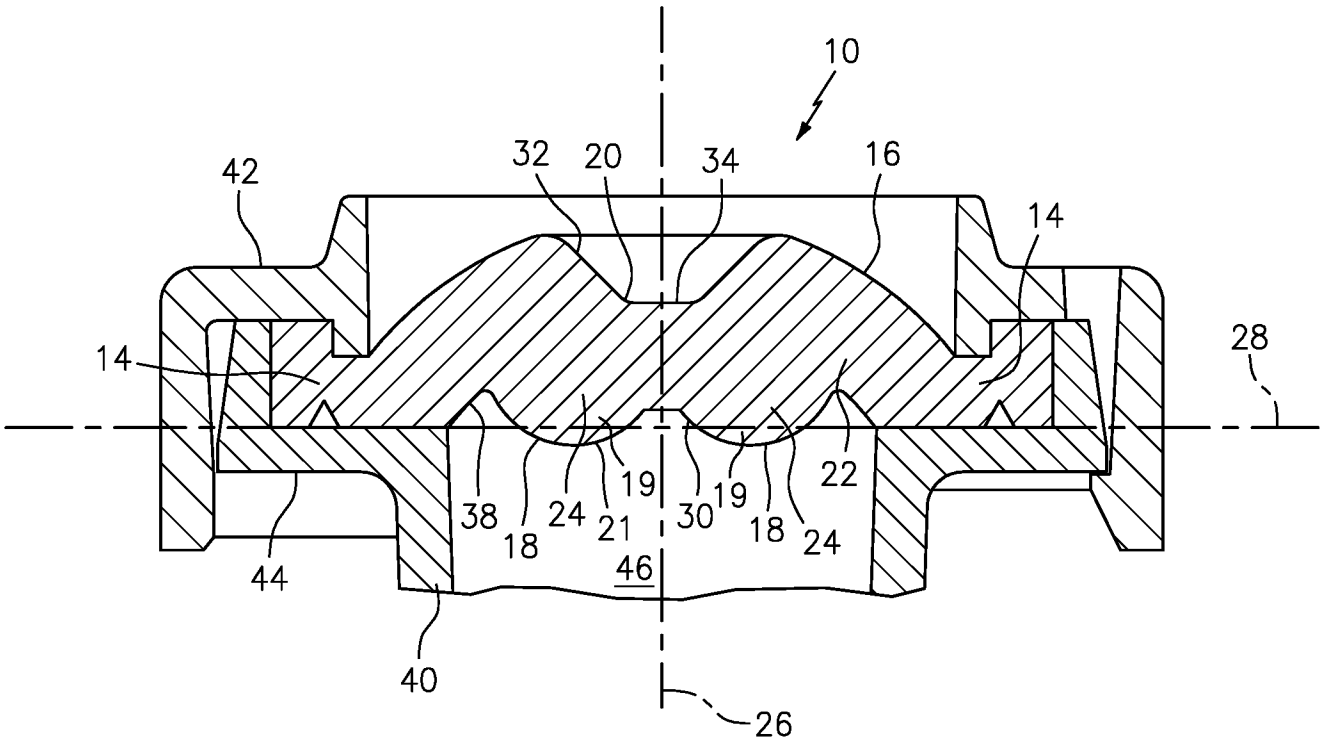
FIG. 2 is a cross-sectional view of the septum of FIG. 1 secured to the vial by a snap ring.
Figure 3:
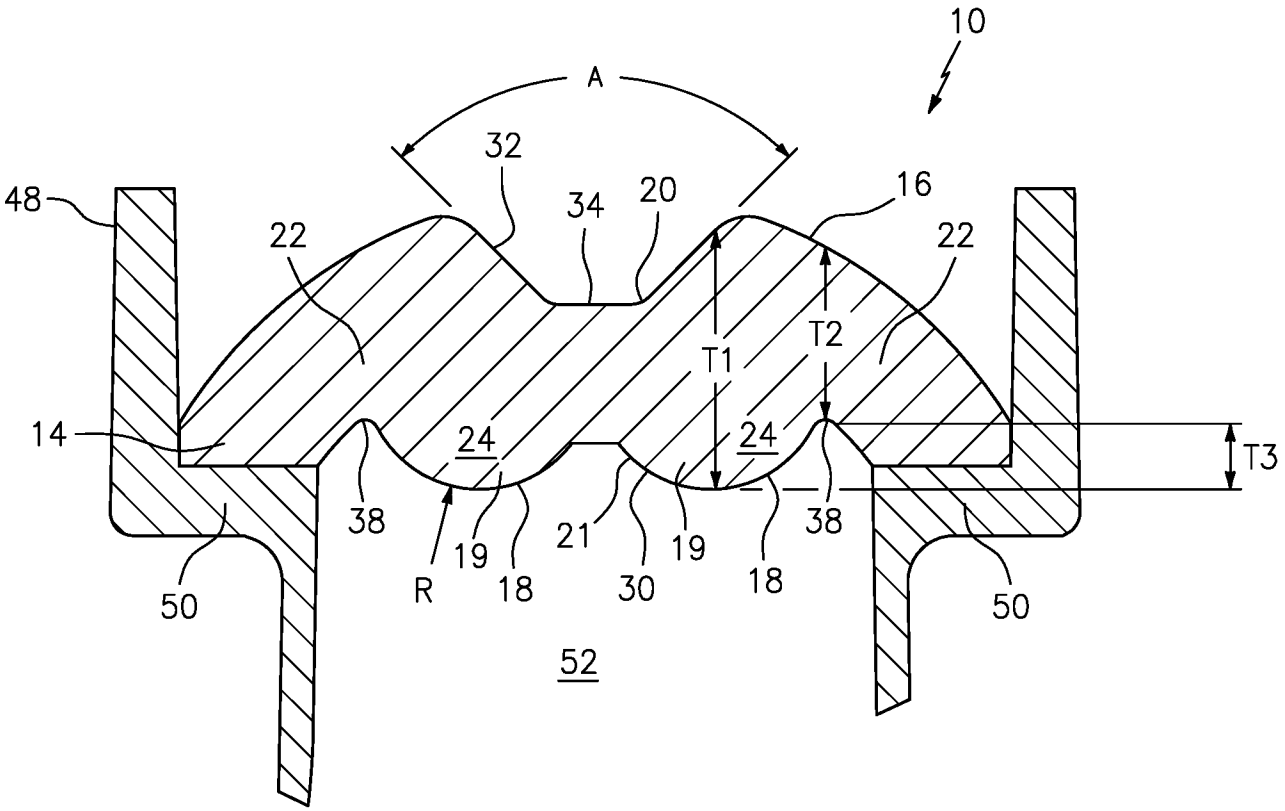
FIG. 3 is a cross-sectional view of a septum mounted to a port of a flexible pouch to seal a chamber of the pouch.

In FIGS. 1 through 3, a septum is indicated generally by the reference numeral 10. As shown in FIG. 1, the septum 10 is penetrable by a needle 12 or other penetrating element, and as described further below, is decontaminated by interaction between the septum and penetrating element. The septum 10 comprises a peripheral portion 14 extending about a periphery of the septum, an exterior surface 16 located on one side of the septum, and an interior surface 18 located on an opposite side of the septum. A penetration area or portion 20 of the septum extends between the exterior and interior surfaces 16 and 18, respectively, is spaced inwardly of the peripheral portion 14, and is penetrable by the needle 12 or other penetrating element. A flex portion 22 of the septum is located between the penetration portion 20 and the peripheral portion 14. A thicker portion 24 of the septum extends between the flex portion 22 and the penetration portion 20, and defines an increased thickness between the exterior and interior surfaces 16 and 18, respectively, relative to the flex portion 22. The flex portion 22 is flexible inwardly relative to the peripheral portion 14 during penetration of the penetration portion 20 by the needle 12 or other penetration element, and as described further below, the penetration portion 20 physically interacts with and decontaminates the needle 12 or other penetration element.

The thicker portion 24 extends annularly about the penetration portion 20. As shown in FIG. 2, the septum 10 defines an axis of symmetry 26, the flex portion 22 is located on one side of a plane 28 that is substantially normal to the axis of symmetry 26, and at least a portion of the interior surface 18 defining the thicker portion 24 is located on an opposite side of the plane 28 relative to the flex portion. As can be seen, the interior surface 18 of the thicker portion 24 is spaced below the plane 28, and the interior surface of the flex portion 22 is spaced above the plane. As also shown in FIGS. 1 and 2, the thicker portion 24 is defined by a curvilinear-shaped interior surface 18. In the illustrated embodiment, the thicker portion 24 is defined by a substantially dome-shaped interior surface 18. Also in the illustrated embodiment, the dome-shaped thicker portion is defined by a substantially toroidal-shaped interior surface 21 formed on the underside of the septum, and includes a recess 30 on the underside of the penetration portion 20. The surface may also be semi-toroidal, partially toroidal, or any other configuration known to those of skill in the art having the characteristics described herein. The term toroidal shaped is used in the remainder of this application to include semi-toroidal and partial toroidal shapes. As shown in FIGS. 2 and 3, the toroidal-shaped thicker portion 24 is substantially convex-shaped in cross section, and defines in cross section two substantially convex, downwardly depending lobes 19 with the recess 30 formed therebetween. As shown in FIG. 3, the interior surface 18 of each lobe 19 is defined by a single radial curve "R." As shown in FIGS. 2 and 3, the toroidal-shaped lobes 19 extend downwardly below the plane 28, whereas the flex portion 22 is located above the plane 28. As shown typically in FIG. 3, the thicker portion 24 defines a thickness T1 in the axial direction that is greater than the thickness T2 of the flex portion 22 in the axial direction. The thickness T1 may beat least about 10% greater, can be at least about 20% greater, can also be at least about 25% greater, and can even beat least about 30% greater, than the thickness T2. The additional thickness provided by the thickness T1, coupled with the radial curvature of R (or other substantially dome-shaped or substantially toroidal-shaped configuration), reduces the strain on the interior surface as compared to the exterior surface at the penetration site, provides an annular zone or ring of safety between the exterior and interior surfaces at the penetration site, and facilitates formation of the annular ring of relatively high radial pressure for wiping and decontaminating the needle or other penetration element during penetration. As may be recognized by those of ordinary skill in the pertinent art based on the teachings herein, the thicker portion 24 of the septum may take any of numerous different configurations or shapes that are currently known or that later become known. For example, rather than being toroidal-shaped, the interior surface could be a convex shape without the recess at the penetration portion, such as a convex shape defined by a single radius of curvature.

As shown in FIGS. 1 and 2, the penetration portion 20 defines a reduced thickness between the exterior and interior surfaces 16 and 18, respectively, as compared to the thicker portion 24. As can be seen, the exterior surface 16 is both substantially dome-shaped and substantially convex-shaped. The penetration portion 20 is defined by a recess 32 in the exterior surface. In the illustrated embodiment, the recess 32 is substantially frustoconically-shaped. As shown in FIG. 3, the recess 32 defines an included angle A. The included angle A is about equal to or slightly greater than (e.g., about ½° to about 10° greater than) the included angle of the tip 36 of the needle 20. The recess 32 defines a substantially planar base portion 34 forming a penetrable exterior surface of the penetration portion 20. As may be recognized by those of ordinary skill in the pertinent art based on the teachings herein, the penetration portion 20 may take any of numerous different configurations or shapes that are currently known or that later become known. For example, the exterior surface 16 of the septum may define a dome shape without a recess at the penetration portion (e.g., with a substantially flat or dome shape at the penetration portion), or with a different recess shape or configuration than that shown. One advantage of a conically-shaped recess is that it allows the penetration portion to substantially mate with or contact the needle tip when the needle tip engages the septum to facilitate intimate contact between the penetration portion and needle tip and to thereby enhance the wiping and decontamination effect. Yet another advantage is that the recess (on both the upper and underside of the penetration portion) provides for a reduced thickness at the base 34 of the penetration portion and, in turn, allows for a reduced penetration force by the needle as compared to septa defining thicker penetration portions. This reduced penetration force can assist in preventing invagination, curling, or rolling inwardly at the penetration hole about the needle.

The flex portion 22 includes an annular recess or groove 38 in the interior surface 18 extending about the thicker portion 24 between the thicker portion and the peripheral portion 14. In the illustrated embodiment, the groove 38 extends annularly about the thicker portion 24 and extends radially between the peripheral portion 14 and the thicker portion 24. In the illustrated embodiment, the groove 38 is substantially v-shaped in cross-section. However, as may be recognized by those of ordinary skill in the pertinent art based on the teachings herein, the groove or recess of the flex portion may take any of numerous different shapes or configurations that are currently known, or that later become known, such as a u-shape or a concave shape, so as to facilitate flexing of the septum and engagement of the needle or like penetrating element 12 by the thicker portion 24 during penetration of the penetration portion 20. As shown in FIG. 3, the thicker portion 24 extends below the base of the annular recess 38 of the flex portion 22 by an axial thickness T3. The additional thickness T3 can be at least about 5%, at least about 10%, at least about 15%, and even at least about 20%, of the thickness T1 of the thicker portion 24. The additional thickness T3, coupled with the curvilinear shape of the interior surface 18 at the thicker portion 24, reduces the strain on the interior surface 18 as compared to the exterior surface 16 at the site of penetration, provides an annular zone or ring of safety between the exterior 16 and interior surfaces 18 at the penetration site, and facilitates formation of the annular ring of relatively high radial pressure for wiping and decontaminating the needle or other penetration element 12 during penetration.

In FIGS. 1 and 2, the septum 10 is fixedly secured to the mouth of a vial 40 by a snap ring 42. As can be seen, in that embodiment, the peripheral portion 14 is seated on an annular flange 44 at the mouth of the vial, and is compressed between the snap ring 42 and mounting flange 44 to form a compression seal and thereby seal a sterile interior chamber 46 of the vial from ambient atmosphere, such as to form a hermetic seal. In FIG. 3, on the other hand, a septum 10 is mounted with a port 48 of a pouch (not shown). As can be seen, the peripheral portion 14 of the septum is seated on an annular flange 50 of the port 48 to thereby seal a sterile interior chamber 52 of the pouch from the ambient atmosphere, such as to form a hermetic seal. In such embodiments, the peripheral portion 14 need not be compressed. In the illustrated embodiment, the peripheral portion 14 (along with the septum itself) is co-molded with the port, such as by over-molding the septum and its peripheral portion 14 to the annular flange 50 of the port to thereby fixedly secure, and seal the peripheral portion of the septum to the mounting flange of the port. As can be seen, the septa of FIGS. 2 and 3 are the same in material respects except for the shape of the peripheral portion 14. In FIGS. 1 and 2, the peripheral portion 14 is configured for mounted to the vial 40 and forming a compression seal between the vial mounting surface 44 and snap ring 42; whereas in FIG. 3, the peripheral portion 14 is configured for co-molding with the annular flange 50 of the port 48. As may be recognized by those of ordinary skill in the pertinent art based on the teachings herein, the peripheral portion may take any of numerous different shapes or configuration that are currently known, or that later become known, to allow use of the septa with any of numerous different devices that are currently known or that later become known, and to allow attachment of the septa to any such device in accordance with any of numerous different processes or mechanisms that are currently known, or that later become known.

Figure 4A:
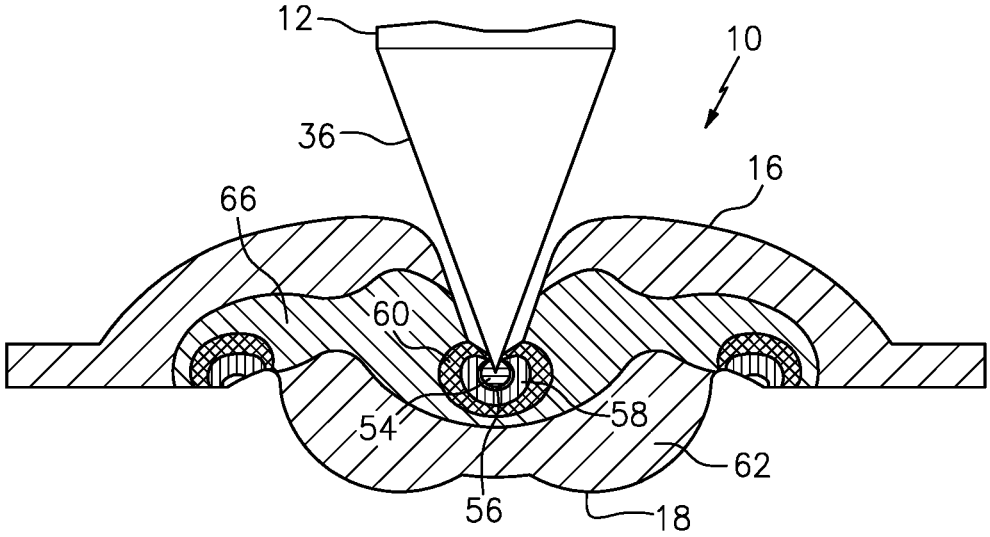
FIGS. 4A through 4C are cross-sectional views illustrating the progression of a filling needle penetrating through the penetration area of a septum similar to the septums shown in FIGS. 1 through 3, and illustrating through use of shading the relatively high, radially-directed pressure at the interface of the exterior surface of the penetration area and the needle, as compared to the radial pressure between the thicker portion and interior surface, respectively, and the needle.
Figure 4B:
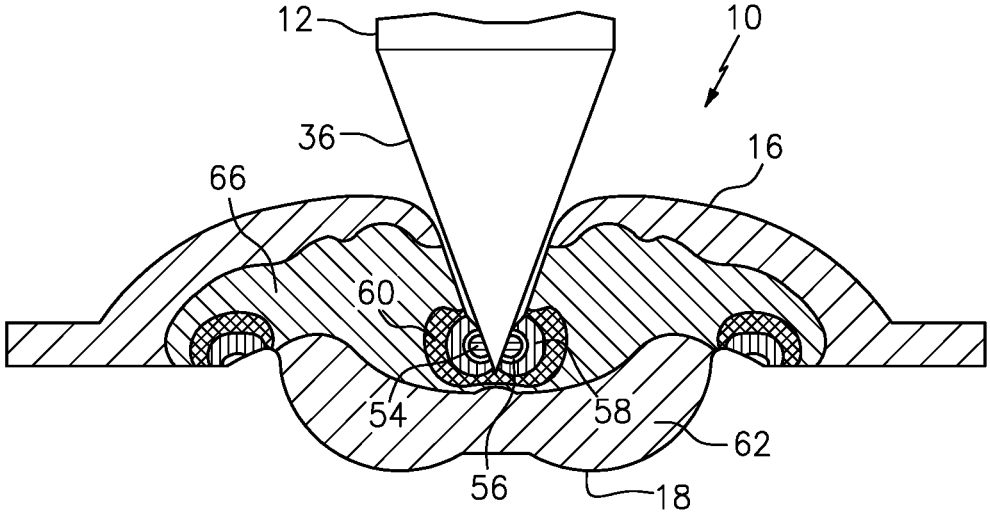
Figure 4C:
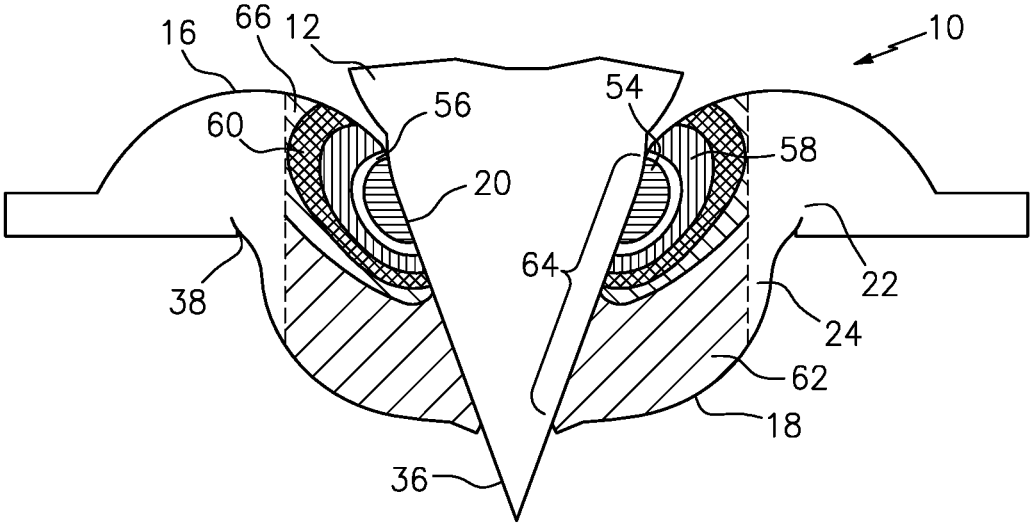

Turning to FIGS. 4A through 4C, the tip 36 of the needle 12 is shown progressively penetrating through the penetration portion 20 of the septum 10. The different shading illustrates the different levels of pressure in and about the penetration portion of the septum during penetration by the needle. The innermost, horizontally shaded region 54 is at the highest or a relatively high pressure, the unshaded zone or region 56 is at a lower pressure than the horizontally shaded zone 54, the zone or region with vertical shading 58 is at a lower pressure than the unshaded zone or region 56, the zone or region with hatched shading 60 is at a lower pressure than the zone or region with vertical shading 58, the zone or region with backward slanted shading 66 is at a lower pressure than the zone or region with hatched shading 60, and the zone or region with forward slanted shading 62 is at a lower pressure than the zone or region with backward slanted shading 66. Although the zones or regions are shown having uniform shading within each zone or region, the pressure within each zone or region may vary. In addition, although the boundaries between each zone and region are demarcated as discrete cut-offs, there may be progressive variations in pressure, i.e., without sharp cut-offs between different zones or regions.

In some embodiments, the following pressures are exerted on the septum or needle in each of the regions or zones:

| Depiction of Region | Pressure (MPa) |
|---|---|
| Horizontal | 0.50-0.63 |
| Clear | 0.43-0.50 |
| Vertical | 0.23-0.43 |
| Hatched | 0.14-0.23 |
| Backward Slanted | 0.03-0.14 |
| Forward Slanted | 0-0.03 |

The dome-, convex- or other curvilinear-shaped exterior surface 16 of the septum 10, in cooperation with the thicker portion 24, applies an at least substantially annular zone 54 that can be seen in the Figures of relatively high radial pressure (e.g, horizontal or red) located at the interface of the needle tip 36 and the exterior surface 16 of the penetration portion contiguous and/or adjacent to the point where the needle tip penetrates the exterior surface 16. The horizontal or red zone 54 defines an annular zone of relatively high, approximately radial pressure between the exterior surface 16 of the penetration portion 20 and the needle 36, as compared to the approximately radial pressure in the forward slanted or purple zone 62 between the interior surface 18 of the penetration portion 20 and the needle 12, during penetration by the needle. As can be seen, the clear shaded/yellow and vertically shaded/green zones, 56 and 58, respectively, and to a lesser extent, the hatched shaded/light blue zone 60, also contribute to forming the annular zone of relatively high, approximately radial pressure.

As shown in FIG. 4A, when the needle 12 penetrates the septum, and downward force is placed on the penetration portion 20, the portion of the septum surrounding recess 32 provides a radially-inward force against the needle. This force creates friction with the needle 12 that wipes the needle 12 when it is inserted.

The annular ring of relatively high pressure at the interface of the interior surface of the penetration portion and the needle wipes the entire surface of the needle as it penetrates through the penetration portion. The annular ring of approximately radially directed, relatively high pressure causes the penetration portion to wipe the surface(s) of the needle, and thereby decontaminate the needle through such physical interaction between the septum and penetrating element. As also shown exemplarily in FIGS. 4A through 4C, the thicker portion 24 of the septum reduces the strain on the interior surface 18 of the penetration portion as compared to the exterior surface 16 of the penetration portion during penetration by the needle 12. This is demonstrated in FIGS. 4A-C by the lower radial pressure at the interior surface 18 of the septum as compared to the exterior surface 16. As a result, when the needle 12 pierces through the interior surface 18 of the penetration portion 20, the exterior surface 16 is restricted or prevented from invaginating, curling or rolling inwardly due to downward deformation of the septum 10 by the downward force of the needle 12 at the penetration hole about the needle. This, in turn, prevents or reduces any germs, bacteria or other contaminants on the exterior surface at the penetration hole from being placed in communication with, and contaminating the interior of the septum, or the interior chamber of the device that the septum is mounted to.

As shown best in FIG. 4C, the thicker portion 24 spaces the exterior surface 16 at the penetration portion 20 from the interior surface 18 thereof during penetration by the needle 12 to thereby provide an annular zone or ring of safety 64 between the exterior and interior surfaces 16, 18 where the needle 12 penetrates the penetration portion 20. As the needle 12 penetrates the penetration portion, it stretches the material of the penetration portion, thereby reducing the cross-sectional thickness of the penetration portion 20 at the interface between the needle and penetration portion 20. However, the additional thickness T1 provided by the thicker portion 24 about the penetration portion 20 maintains sufficient spacing between the exterior and interior surfaces 16 and 18, respectively, at the interface between the needle 12 and the septum 10, to thereby provide a ring or zone of safety 64 that prevents or reduces any germs, bacteria or other contaminants that might exist on the exterior surface 16 from migrating or otherwise passing through to the interior surface 18 of the septum 10.

The relatively high pressure interface between the septum 10 and needle 12 provides a relatively high pressure wiping wave along the surfaces of the needle as it penetrates through the penetration portion 20 of the septum 10 to thereby decontaminate the surfaces through physical interaction, such as by the stress and friction at the interface. This wiping wave is further illustrated by the progressive movement of the highest pressure zone 54 from lowest portion of the tip 36 in FIG. 4A, to an intermediate portion in FIG. 4B, to an upper portion of the tip in FIG. 4C. Contaminants are carried by this wiping wave from the bottom of tip 36 to a point within the ring or zone of safety 64, and ultimately away from the interior surface 18 of the septum 10.

Figure 5A:
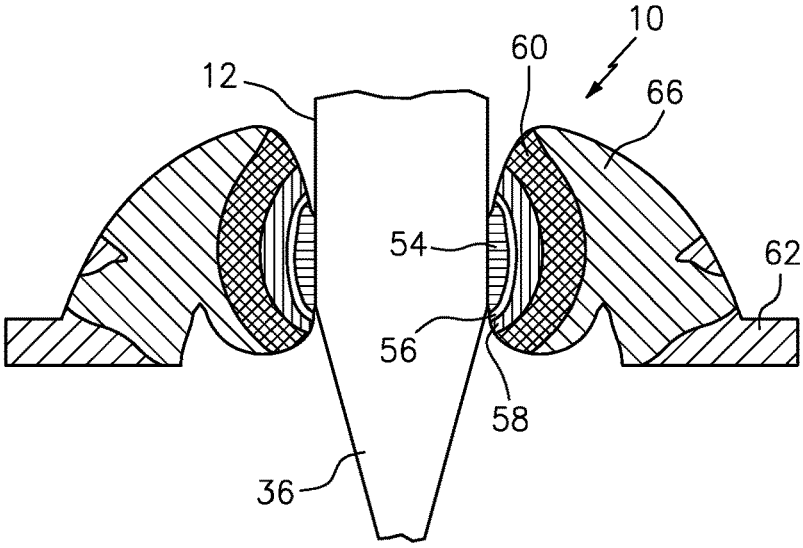
FIGS. 5A-5C are cross-sectional views illustrating the withdrawal of a filling needle from the penetration area of a septum similar to the septums shown in FIGS. 1 through 4C, and illustrating through use of shading the relatively high, radially directed pressure at the interface of the exterior surface of the penetration area and the needle, as compared to the radial pressure, and further illustrating the visco-elastic features of the septum that reduce or prevent retrograde contamination of the septum as the needle is withdrawn.
Figure 5B:
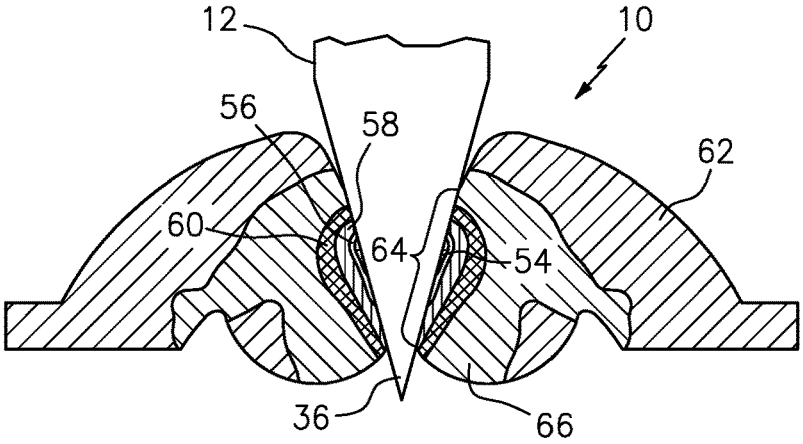
Figure 5C:
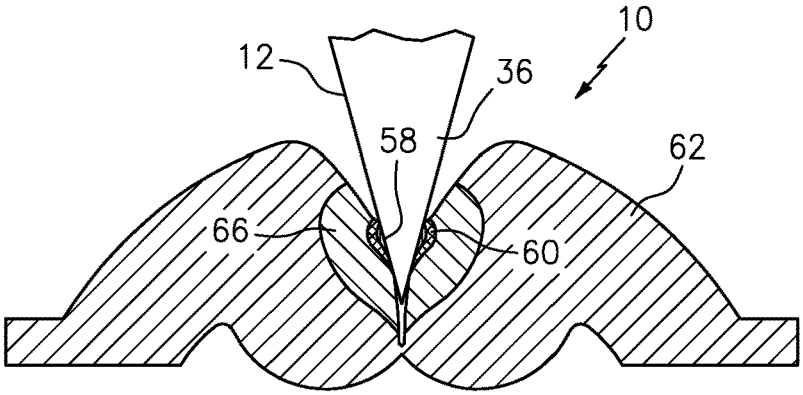

Turning to FIGS. 5A-5C, the tip 36 of the needle 12 is shown progressively withdrawing from the penetration portion 20 of the septum 10. The different types of shading illustrate the different levels of pressure in and about the penetration portion of the septum during withdrawal of the needle. The same patterns of shading that were used in FIGS. 4A-4C are used in FIGS. 5A-5C. As in FIGS. 4A-4C, although the zones or regions are shown having uniform shading within each zone or region, the pressure within each zone or region may vary. In addition, although the boundaries between each zone and region are demarcated as discrete cut-offs, there may be progressive variations in pressure, i.e., without sharp cut-offs between different zones or regions.

After the needle is inserted into the container and fluid is delivered therethrough, liquid film can remain on the surface of the needle. When the needle is withdrawn, this liquid film could become exposed to the atmosphere and pick up contaminants. These contaminants could, in turn, flow through the liquid film and into the container, e.g., by dripping, thus contaminating the substance in the container.

The configuration of the septum as shown in FIGS. 5A-5C prevents or reduces this retrograde contamination. As the needle is withdrawn, and as shown particularly in FIG. 5B, ring of safety 64 maintains a tight seal of material against the needle, helping to prevent liquid or contaminants from passing through the ring of safety into the container.

As illustrated in FIG. 5C, as the needle is withdrawn from the septum, the aperture formed by the penetration of the needle 12 closes from an interior to an exterior direction. That is, the bottom portion of the septum (near interior surface 18) is sealed, even though the needle remains within the upper portion of the septum 10 (near exterior surface 16). The radial force exerted by the septum, which is greater than merely the restorative force of the elastic of the septum, closes the hole in the septum. The tapered shape of the needle facilitates this closure by causing the needle to be withdrawn from the septum progressively. As the needle is further withdrawn, correspondingly higher portions of the septum (toward the exterior surface 16) are sealed. There is thus no open hole or pathway for the liquid to pass through the septum and into the container. In addition, the septum design, including recess 32, generates a wiping action. The configuration of the septum, e.g., the ring of safety, causes the septum to exert a radially-inward force against the needle that is greater than merely the elastic restorative force of the septum material. This radially-inward force, in combination with the progressive (upward) closing of the hole in the septum, creates a wiping wave that wipes the needle in an upward direction, toward the exterior of the septum, and pushes liquid film and contaminants on the needle or at the interface of the septum 10 and needle 12 upwardly and outwardly out of the septum aperture. This is demonstrated in FIGS. 5A-5C, which show the region of higher pressure/ring of safety progressing toward the exterior surface 16 of the septum 10 as the needle 12 is withdrawn.

In some embodiments, following withdrawal of the needle from the septum, the resulting needle or penetration hole in the septa is self-resealed. This self-resealing occurs due to the elastic nature of the septum material, and the radial compression applied to such hole due to the dome or other curvilinear shapes of the exterior and/or interior surfaces of the septum. The self-resealing feature further protects the interior of the container from contamination.

The septa of the present invention may take the form or appearance of any septum that having the above-described features. For example, the septa may take the appearance of any of the septa disclosed in U.S. patent application Ser. No. 29/539,571, entitled "Septum," filed Sep. 15, 2015, the contents of which are hereby incorporated by reference.

The septa of the present invention may be used with or in any of numerous different devices, filled in any of numerous different filling apparatus, and filled in accordance with any of numerous different filling methods, including the devices, apparatus and methods disclosed in the following co-pending patent applications, which are hereby incorporated by reference in their entireties as part of the present disclosure: U.S. patent application Ser. No. 14/214,890, filed Mar. 15, 2014, which claims benefit under 35 U.S.C. § 119(e) to U.S. Provisional Patent Application No. 61/798,210, filed Mar. 15, 2013; U.S. patent application Ser. No. 14/990,778, filed Jan. 7, 2016, which claims benefit under 35 U.S.C. § 119(e) to U.S. Provisional Patent Application No. 62/100,725, filed Jan. 7, 2015; U.S. Provisional Patent Application No. 62/280,700, filed Jan. 19, 2016; U.S. Provisional Patent Application No. 62/295,139, filed Feb. 14, 2016; U.S. Provisional Patent Application No. 62/298,214, filed Feb. 22, 2016; U.S. Provisional Patent Application No. 62/323,561, filed Apr. 15, 2016. In addition, the septa of the present invention may be used in or as part of any of numerous different sterile connectors or other types of connectors, including any of the connectors disclosed in the following co-pending patent applications, which are hereby incorporated by reference in their entireties as part of the present disclosure: U.S. patent application Ser. No. 13/864,919, filed Apr. 17, 2014, which claims benefit under 35 U.S.C. § 119(e) to U.S. Provisional Patent Application No. 61/625,663, filed Apr. 17, 2012, No. 61/635,258, filed Apr. 18, 2012, and No. 61/784,764, filed Mar. 14,2013; and U.S. patent application Ser. No. 13/874,839, filed May 1, 2013 and U.S. patent application Ser. No. 14/535,566, filed Jul. 11, 2014, both of which claim benefit under 35 U.S.C. § 119(e) to U.S. Provisional Patent Application No. 61/641,248, filed May 1, 2012.

As may be recognized by those of ordinary skill in the pertinent art based on the teachings herein, numerous changes and modifications may be made to the above-described and other embodiments of the present invention without departing from its scope as defined, for example, in the appended claims. For example, the septa may be made of any of numerous different materials, such as any of numerous different natural or synthetic elastic materials, such as rubber, thermoplastic, silicone, or any of numerous different combinations or blends of one or more of the foregoing, that are currently known, or that later become known. In addition, the external shape and appearance of the septa may differ from the external shape and/or appearance illustrated herein. In addition to being self resealing, the septa may be configured for resealing with any of numerous different resealing mechanisms or processes that are currently known, or that later become known. For example, the septa may be configured for resealing through use of a liquid sealant, as disclosed in U.S. patent application Ser. No. 13/861,502, filed Apr. 12, 2013, now U.S. Pat. No. 8,966,866, issued Mar. 3, 2015, the contents of which are hereby incorporated by reference in its entirety as part of the present disclosure. The septa may also be configured for resealing by mechanical, chemical or thermal resealing, where the thermal resealing may be induced with any of numerous different energy sources or devices that are currently known or that later become known, such as by laser or ultrasonic mechanisms. It should further be understood that the features disclosed herein can be used in any combination or configuration, and are not limited to the particular combinations or configurations expressly specified or illustrated herein. Accordingly, this detailed description is to be taken in an illustrative as opposed to a limiting sense.

What is claimed is:

1. A septum comprising:

an exterior surface located on an external side of the septum, and an interior surface located on an opposite side of the septum;

a penetration portion penetrable by a needle or other penetrating element extending between the exterior and interior surfaces;

wherein, when the penetration portion is penetrated with the needle or other penetrating element the septum applies a zone of relatively high, approximately radial pressure onto the needle or other penetrating element at or near the exterior surface and applies a zone of relatively lower, approximately radial pressure onto the needle or other penetrating element at or nearer to the interior surface; and the septum progressively wipes an exterior surface of the needle or other penetrating element at at least the zone of relatively high, approximately radial pressure and thereby decontaminates portions of the needle or other penetrating element that has penetrated the septum.

2. A septum as defined in claim 1, further comprising an increased thickness portion peripheral to the penetration portion.

3. A septum as defined in claim 2, wherein the increased thickness portion extends annularly about the penetration portion.

4. A septum as defined in claim 2, wherein the increased thickness portion is defined by a substantially dome-shaped interior surface.

5. A septum as defined in claim 2, wherein the increased thickness portion is defined by an interior surface that is toroidal, semi-toroidal or partial toroidal in shape.

6. A septum as defined in claim 2, wherein the increased thickness portion is defined by a curvilinear-shaped interior surface.

7. A septum as defined in claim 2, wherein the increased thickness portion is substantially convex-shaped in cross section.

8. A septum as defined in claim 2, wherein the penetration portion defines a reduced thickness between the exterior and interior surfaces as compared to the increased thickness portion.

9. A septum as defined in claim 1, wherein the exterior surface is one or more of substantially dome-shaped or substantially convex-shaped.

10. A septum as defined in claim 1, wherein the penetration portion defines a recess in the exterior surface.

11. A septum as defined in claim 10, wherein the recess of the penetration portion is substantially conically shaped.

12. A septum as defined in claim 10, wherein the recess of the penetration portion is substantially frustoconically shaped.

13. A septum as defined in claim 10, wherein the recess of the penetration portion defines a substantially planar base forming a penetrable exterior surface of the penetration portion.

14. A septum as defined in claim 2, wherein the exterior surface is approximately dome-shaped and the interior surface at the increased thickness portion is approximately dome-shaped.

15. A septum as defined in claim 2, wherein the exterior surface is approximately convex-shaped and the interior surface at the increased thickness portion is approximately convex-shaped.

16. A septum as defined in claim 2, wherein the increased thickness portion is configured to one or more of (i) reduce strain on the interior surface as compared to the exterior surface during penetration of the penetration portion by the needle or other penetrating element; or (ii) space the exterior surface from the interior surface thereof during penetration of the penetration portion by the needle or other penetrating element.

17. A septum as defined claim 1, wherein the interior surface of the septum is sterile.

18. A septum as defined in claim 2, wherein the penetration portion and increased thickness portion are each made of an elastic material, and the exterior surface is one or more of curvilinear, substantially convex or substantially dome-shaped, and a resulting penetration hole from the needle or other penetrating element is self-resealing.

19. A septum as defined in claim 1, wherein an aperture formed in the septum by the needle or other penetrating element closes or seals progressively in a direction from the interior surface of the septum toward the exterior surface of the septum as the needle or other penetrating element is withdrawn from the septum.

20. A septum as defined in claim 1, wherein the septum prevents liquid or contaminants exterior to the needle or other penetrating element from passing or flowing to the interior surface of the septum as the needle or other penetrating element is withdrawn from the septum.

21. A septum as defined in claim 1, wherein the septum moves liquid or contaminants from one or more of (i) an exterior surface of the needle or other penetrating element or (ii) the penetration portion and toward the exterior surface of the septum during withdrawal of the needle or other penetrating element from the septum.

22. A septum as defined in claim 1, wherein the septum applies a pressure to the needle or other penetrating element of at least 0.4 MPa.

23. A method comprising:

penetrating a septum with a needle or other penetrating element, the septum comprising:

a peripheral portion extending about a periphery of the septum;

a penetration portion, having an exterior surface and an interior surface and extending between the exterior and interior surfaces, that is spaced radially inwardly of the peripheral portion and is penetrable by the needle or other penetrating element;

a flex portion located radially between the penetration portion and the peripheral portion; and an increased thickness portion extending radially between the flex portion and the penetration portion, and defining an increased thickness between the exterior and interior surfaces relative to the flex portion, wherein the flex portion is flexible inwardly relative to the peripheral portion during penetration of the penetration portion by a needle or other penetrating element;

wherein the septum is configured to decontaminate a needle or other penetrating element during penetration of the penetration portion therewith by interaction between the septum and said needle or other penetrating element; and during said penetrating step, decontaminating the needle or other penetrating element by interaction between the septum and said needle or other penetrating element.

24. A method as defined in claim 23, further comprising one or more of reducing strain or incurring a lower strain on the interior surface of the penetration portion, as compared to the exterior surface of the penetration portion, during penetration thereof by the needle or other penetrating element.

25. A method as defined in claim 23, further comprising, during the penetrating step, preventing the exterior surface of the penetration portion from invaginating, curling or rolling inwardly about the needle or other penetrating element.

26. A method as defined in claim 23, further comprising preventing any germs, bacteria or other contaminants on the exterior surface of the penetration portion from being placed into communication with, and contaminating the interior surface of the penetration portion, or an environment of an interior surface of the septum.

27. A method as defined in claim 23, further comprising spacing the exterior surface of the penetration portion from the interior surface thereof during the penetrating step, and providing a ring of safety between the exterior and interior surfaces of the penetration portion at an interface of the needle or other penetrating element and the septum that prevents germs, bacteria or other contaminants on the exterior surface of the penetration portion from being placed into communication with, and contaminating the interior of the penetration portion, or an environment of an interior surface of the septum.

28. A method as defined in claim 23, further comprising, during said penetrating step, applying a zone of relatively high, approximately radial pressure onto the needle or other penetrating element at or near the exterior surface of the penetration portion, and applying a zone of relatively lower, approximately radial pressure onto the needle or other penetrating element at or nearer to the interior surface of the penetration portion.

29. A method as defined in claim 23, further comprising, during said penetration step, applying a pressure onto the needle or other penetrating element of at least 0.4 MPa.

30. A method as defined in claim 23, further comprising:

withdrawing the needle or other penetrating element from the septum;

during said withdrawing step, applying a zone of relatively high, approximately radial pressure onto the needle or other penetrating element at or near the exterior surface of the penetration portion, and applying a zone of relatively lower, approximately radial pressure onto the needle or other penetrating element at or near the interior surface of the penetration portion; and progressively wiping the needle or other penetrating element during the withdrawing step and thereby preventing liquid or contaminants from passing or flowing from the exterior surface of the penetration portion or an exterior surface of the needle or other penetrating element to the interior surface of the penetration portion.

31. A method as defined in claim 30, wherein the step of wiping the needle or other penetrating element during the withdrawing step includes wiping the needle or other penetrating element in a direction from the interior surface of the penetration portion toward the exterior surface of the penetration portion.

32. A method as defined in claim 30, further comprising, during the withdrawing step, progressively closing or sealing an aperture formed in the septum by the needle or other penetrating element in a direction from the interior surface of the penetration portion toward the exterior surface of the penetration portion.

33. A method as defined in claim 23, further comprising moving liquid or contaminants from one or more of (i) a surface of the needle or other penetrating element or (ii) the penetration portion toward the exterior surface of the penetration portion during withdrawal of the needle or other penetrating element from the septum.

* * * * *